US005868107A

United States Patent [19]

Betsch et al.

[11] Patent Number: 5,868,107

[45] Date of Patent: Feb. 9, 1999

[54] LIQUID-COOLED MULTI-CYLINDER INTERNAL COMBUSTION ENGINE

[75] Inventors: Jochen Betsch, Waiblingen; Georg Stumpp, Ludwigsburg, both of Germany

[73] Assignee: Daimler-Benz-AG, Stuttgart, Germany

[21] Appl. No.: 998,547

[22] Filed: Dec. 26, 1997

[30] Foreign Application Priority Data

Dec. 27, 1996 [DE] Germany ..... 19654451.3

[51] Int. Cl.[6] ..... F02F 1/36

[52] U.S. Cl. ..... 123/41.82 R; 123/195 R

[58] Field of Search ..... 123/41.82 R, 193.3, 123/195 R

[56] References Cited

U.S. PATENT DOCUMENTS 4,688,523 8/1987 Takahashi et al. ..... 123/41.82 R
5,190,003 3/1993 Voigt ..... 123/195 R

FOREIGN PATENT DOCUMENTS 1 526 328 9/1969 Germany .
2 312 020 6/1996 United Kingdom .

*Primary Examiner*—Noah P. Kamen
*Attorney, Agent, or Firm*—Klaus J. Bach

[57] ABSTRACT

In a liquid cooled multi-cylinder internal combustion engine comprising an engine block having a cooling water space, wherein a cylinder head is mounted on the engine block by cylinder head bolts with a cylinder head gasket disposed therebetween, and the cylinder head includes a water space which is in communication with the engine block water space by passages extending through the gasket and the cylinder head bottom wall, the cylinder head bolts extend through the passages into the engine block in spaced relationship from the walls defining the passages such that cooling water flowing from the engine block cooling water space through the passages to the cylinder head cooling water space, flows along the cylinder head bolts maintaining them at cooling water temperature, and the cylinder head includes in its cooling water space longitudinal ribs extending between the cylinder head bottom and top walls for reinforcing the cylinder head.

6 Claims, 6 Drawing Sheets

LIQUID-COOLED MULTI-CYLINDER INTERNAL COMBUSTION ENGINE

BACKGROUND OF THE INVENTION

The invention relates to a liquid cooled internal combustion engine with an engine block including a cooling water space and a cylinder head mounted on the engine block by cylinder head bolts with a gasket disposed therebetween. The cylinder head includes a cooling water chamber delimited by cylinder head top, bottom, and side walls and for each cylinder intake passages leading to one of the side walls and exhaust passages leading to the opposite side wall. For each cylinder, the cylinderhead has a domed area for receiving a spark plug or a fuel injector, and various openings by way of which the cooling water chamber of the cylinder head is in communication with the cooling water space in the engine block.

In internal combustion engines of this type (see for example, DE AS 1526 328), the cylinder head bolts extend through passages in bolt columns, which are arranged between the cylinder head top wall and the cylinder head bottom wall. They guide the bolts and form a support structure between the cylinder head bottom and the cylinder head top wall to increase the rigidity of the cylinder head. However, after startup of the internal combustion engine, the cylinder head and the engine block heat up substantially faster than the cylinder head bolts. The cylinder head and the engine block are relatively rapidly heated by the cooling water whereas the usually very long cylinder head bolts are heated up only by heat conduction via their contact areas with the cylinder head and via the threaded ends. This leads to a time hysteresis in the temperature curve between the bolts and the surrounding components which results, with the already stretched cylinder head bolts, in a reduction of the bolt forces after repeated startup of the engine. Also, the bolt guide columns form obstacles to the water flow through the cylinder head.

It is the object of the present invention to provide for a more rapid heating of the cylinder head bolts by which the cylinder head is mounted onto the engine block so that any bolt force change is reversible.

SUMMARY OF THE INVENTION

In a liquid cooled multi-cylinder internal combustion engine comprising an engine block having a cooling water space, a cylinder head is mounted on the engine block by cylinder head bolts with a cylinder head gasket disposed therebetween. The cylinder head includes a water space which is in communication with the engine block water space by passages extending through the gasket and the cylinder head bottom wall. The cylinder head bolts extend through the passages into the engine block in spaced relationship from the walls defining the passages such that cooling water flowing from the engine block cooling water space through the passages to the cylinder head cooling water space, flows along the cylinder head bolts maintaining them at cooling water temperature. The cylinder head includes in its cooling water space longitudinal ribs extending between the cylinder head bottom and top walls for reinforcing the cylinder head.

With this arrangement, the cylinder head bolts are in direct contact with the cooling water over their full length so that they reach the temperature of the surrounding components very rapidly and the time hysteresis referred to above is reduced to a minimum. By a corresponding selection of the flow cross-sections around the cylinder head bolts, for example, by a corresponding dimensioning of the diameters of the passages in the cylinder head gasket through which the cylinder head bolts extend, an optimal cooling (and heating) of all areas of the cylinder head over the full length and width of the cylinder head can be achieved with relatively low water pump power requirements. The rigidity of the cylinder head normally obtained from the cylinder head bolt-receiving columns is achieved by the longitudinal ribs, which provide essentially no resistance to the cooling water flow since they extend in a longitudinal direction.

Along the exhaust side of the cylinder head, the longitudinal ribs are preferably double ribs, which delimit a longitudinal cooling water channel through which the cylinder head bolts extend. Cooling water is supplied from the engine block to this channel by way of the openings in the cylinder head gasket through which the cylinder head mounting bolts extend. In this way, the large cooling water pressure difference between the engine block and the cylinder head is utilized by way of the water space areas in which the cylinder head bolts are disposed to provide also in the upper part of the cylinder head for an optimal cooling of the thermally highly stressed exhaust side of the cylinder head.

An intense cooling for the dome structure which receives a spark plug or a fuel injector and for the combustion chamber or the cylinder head bottom wall around the dome structure can be achieved in that the double ribs extend through transverse planes disposed between adjacent dome structures. A cooling water discharge gap is left between adjacent double ribs whereby the longitudinal channel is in direct communication with the area of the cooling water space around the respective dome structure. With such a configuration cooling water is supplied to the dome structure from the top in a controlled manner.

In order to achieve a strong water flow toward the dome structure and, at the same time, further stiffening of the cylinder head, longitudinal ribs may also be provided between adjacent domes and extend from the cylinder head bottom wall to the cylinder head top wall. An optimal flow toward and around the dome structure can be achieved if those ribs end at a distance from the adjacent dome structures.

In an internal combustion engine with two exhaust passages per cylinder, intense cooling of the web between the two exhaust passages, particularly in the vicinity of the valve seats, may be achieved by a web bore, which provides for communication between the cooling water space in the engine block and the cooling water space in the cylinder head. By appropriately limiting the flow cross-section in the cylinder head gasket, a pressure gradient can be generated which provides for the desired intense water flow from the longitudinal channel onto the bottom wall of the cylinder head.

An embodiment of the invention will be described below on the basis of the accompanying drawings.

DESCRIPTION OF A PREFERRED EMBODIMENT

Figure 1:
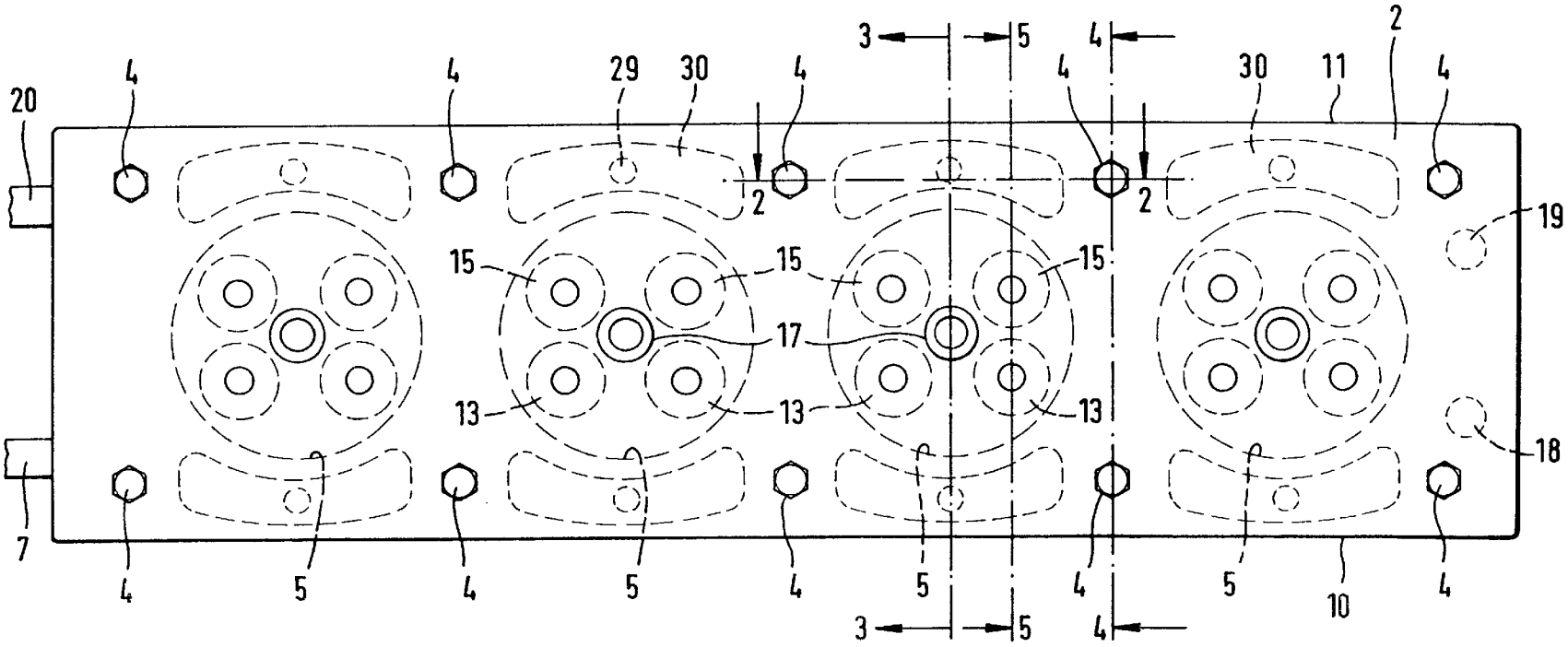
FIG. 1 is a top view of an internal combustion engine showing schematically the cylinder head structure of which the top portion including the valve drive mechanism has been eliminated for clearer representation.
Figure 2:
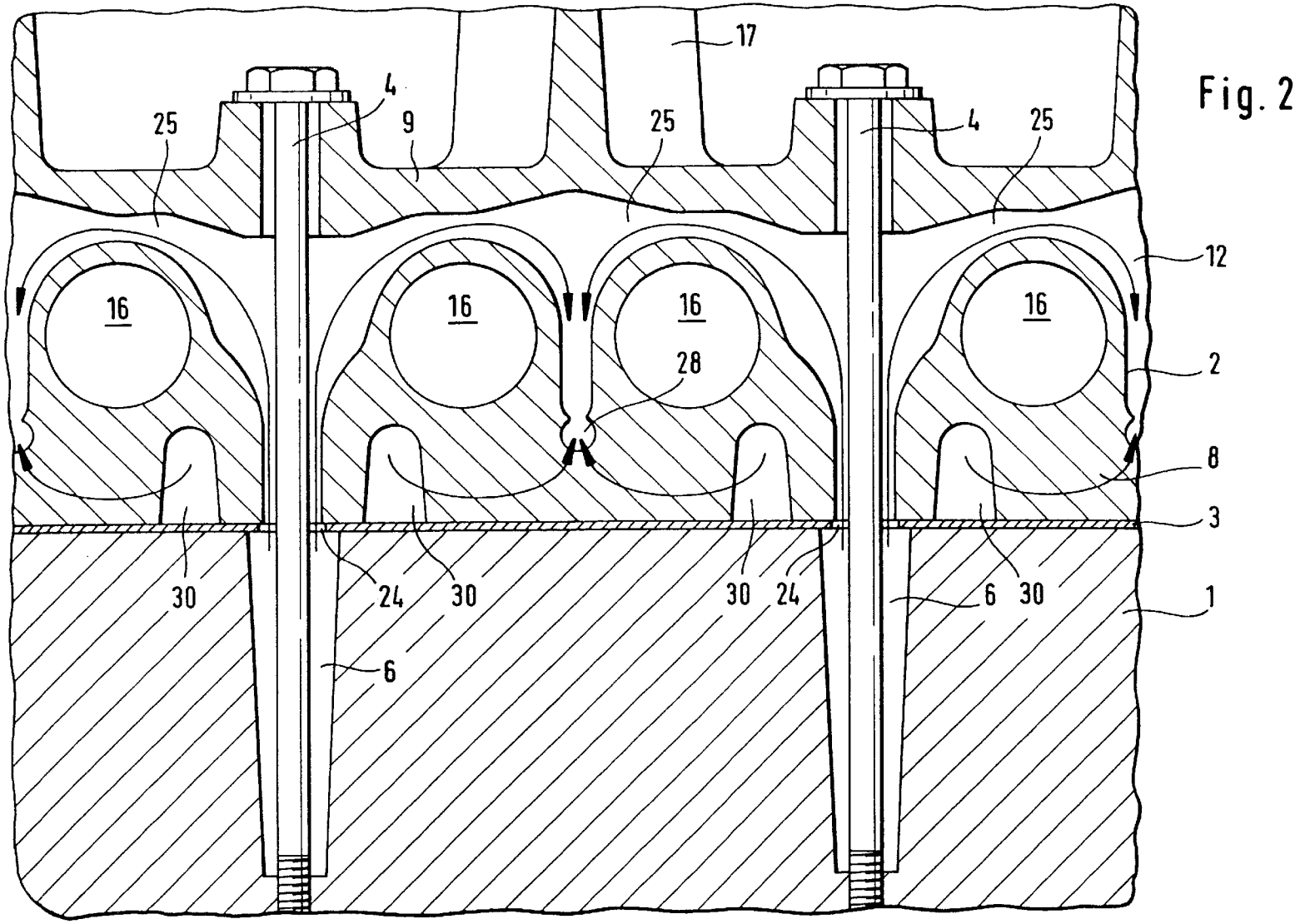
FIG. 2 is a cross-sectional view taken along lines 2—2 of FIG. 1 and FIG. 6.

The internal combustion engine as shown in the figures includes an engine block 1 and a cylinder head 2, which is mounted on the engine block 1 by cylinder head bolts 4 with a cylinder head gasket 3 disposed therebetween. The engine block 1 includes in the example given four cylinders 5 and a cooling water space 6 to which cooling water is supplied under pressure by way of a pipe connection 7 from a cooling water pump which is not shown.

The cylinder head 2 has a cylinder head bottom wall 8, a cylinder head top wall 9 and outer side walls 10 and 11, as well as front and rear outside walls (not shown), which together define a cooling water space 12. The cooling water space 12 is penetrated at each cylinder by two intake passage 16 controlled by intake valves 13 and exhaust passages 16 controlled by exhaust valves 15 and a dome structure 17 for receiving a spark plug or an injector. The intake passages 14 extend from the outer side wall 10 and the exhaust passages 16 terminate at the outer side wall 11. The cooling water space 12 is, at one end of the cylinder head 2, in communication with the cooling water space 6 in the engine block 1 by way of bores 18 and 19. At the opposite end, the cooling water space 12 is provided with a connecting pipe stub 20 for communication with a cooling water pump intake. Cooling water is accordingly conducted through the cooling water space 12 in a longitudinal direction that is, in FIG. 1 from the right to the left.

Figure 4:
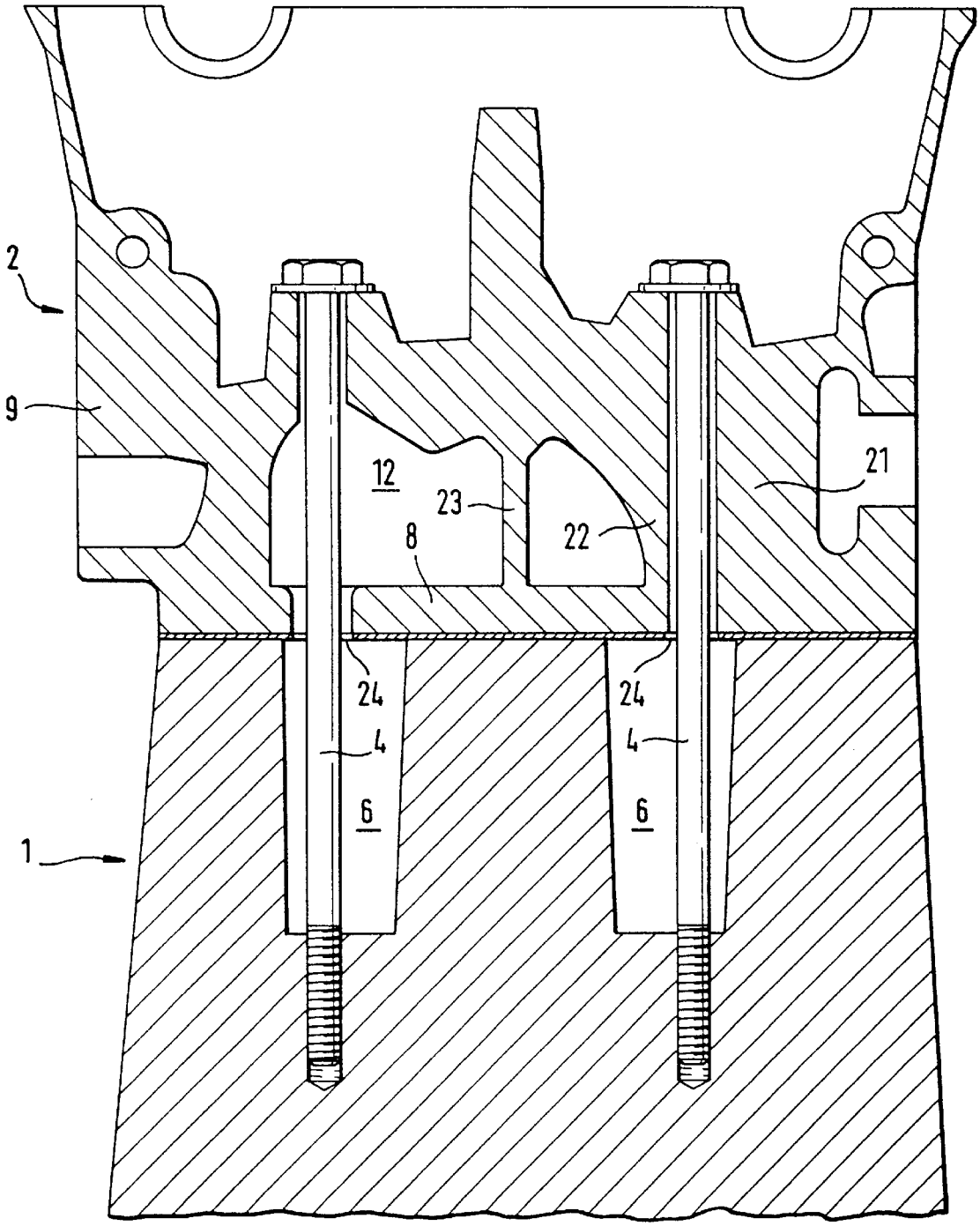
FIG. 4 is a cross-sectional view taken along lines 4—4 of FIG. 1 and FIG. 6.
Figure 5:
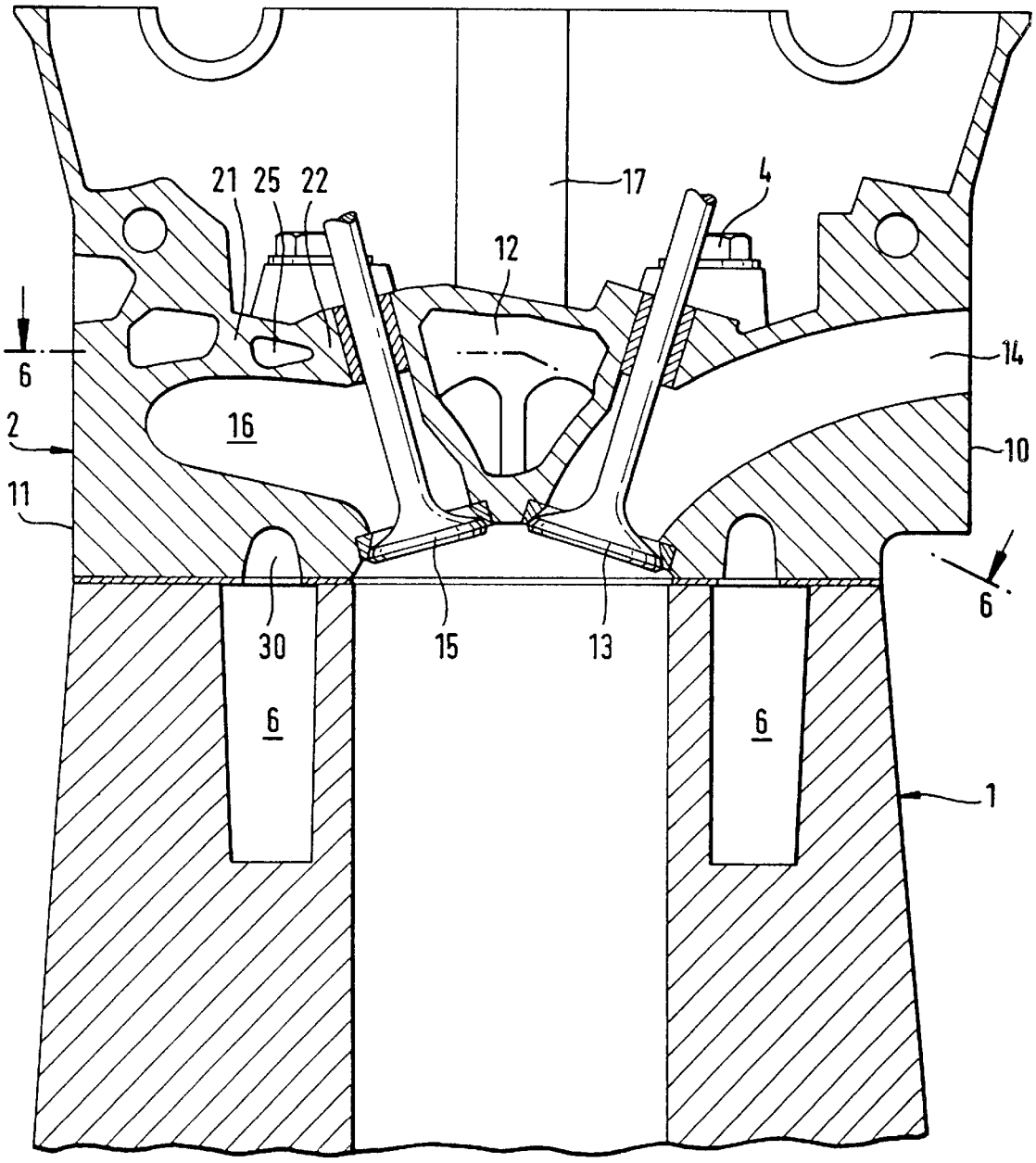
FIG. 5 is a cross-sectional view taken along lines 5—5 of FIG. 1 and FIG. 6.

As apparent especially from FIG. 4, the cylinder head bolts 4 extend openly through the cooling water spaces 6, and 12 in the engine block 1 and the cylinder head 2 respectively. As a result, they are directly contacted by the cooling water and are brought rapidly up to the temperature of the surrounding components. Also, by the elimination of the usual bolt column, the longitudinal coolant flow through the cylinder head is improved. The rigidity of the cylinder head normally obtained by the bolt columns is achieved by providing in the cooling water space 12 at the hot exhaust side double ribs 21, 22 extending in the cylinder head in longitudinal direction between the cylinder head bottom wall 11 and the cylinder head top wall 10 in such a way that a longitudinal channel 25 is formed through which the cylinder head bolts 4 extend. At the cool intake side of the cylinder head, a thickening of the walls of the intake passages is sufficient for carrying the load of the cylinder head bolts. Additional longitudinal ribs 23 are arranged between adjacent dome structures 17.

In order to obtain a substantial equalization of temperature over the full length of the cylinder head 2, the cooling water space 12 is in communication with the cooling water space 6 in the engine block 1, not only by way of the bores 18, 19, but, in addition, by relatively large openings 24 in the cylinder head gasket 3 through which the cylinder head bolts 4 extend. The cooling water entering the cooling water space 6 of the engine block from the left as shown in FIG. 1 flows, as a result, partially through the openings 24 into the cooling water space 12. By special dimensioning of the openings 24, the cooling water flow to the various areas of the cylinder head can be controlled. A particular intense cooling of the exhaust side which is exposed to the highest thermal stress is obtained by supplying cooling water from the cooling water space 6 of the engine block 1 directly to the longitudinal channel 25 which is formed by the double ribs 21, 22 above the exhaust passages 16. The pressure gradient between the cooling water space 6 and the longitudinal channel 22 is controlled by the cross-section of the openings 24 in the cylinder head gasket 3 in such a way that, in spite of the longitudinal cooling system, comparable cooling conditions are achieved for all the cylinders. Since the exhaust valves 15 are guided in a rib 22 of the double ribs 21, 22 additional cooling of the exhaust valve guide structures is achieved.

Figure 6:
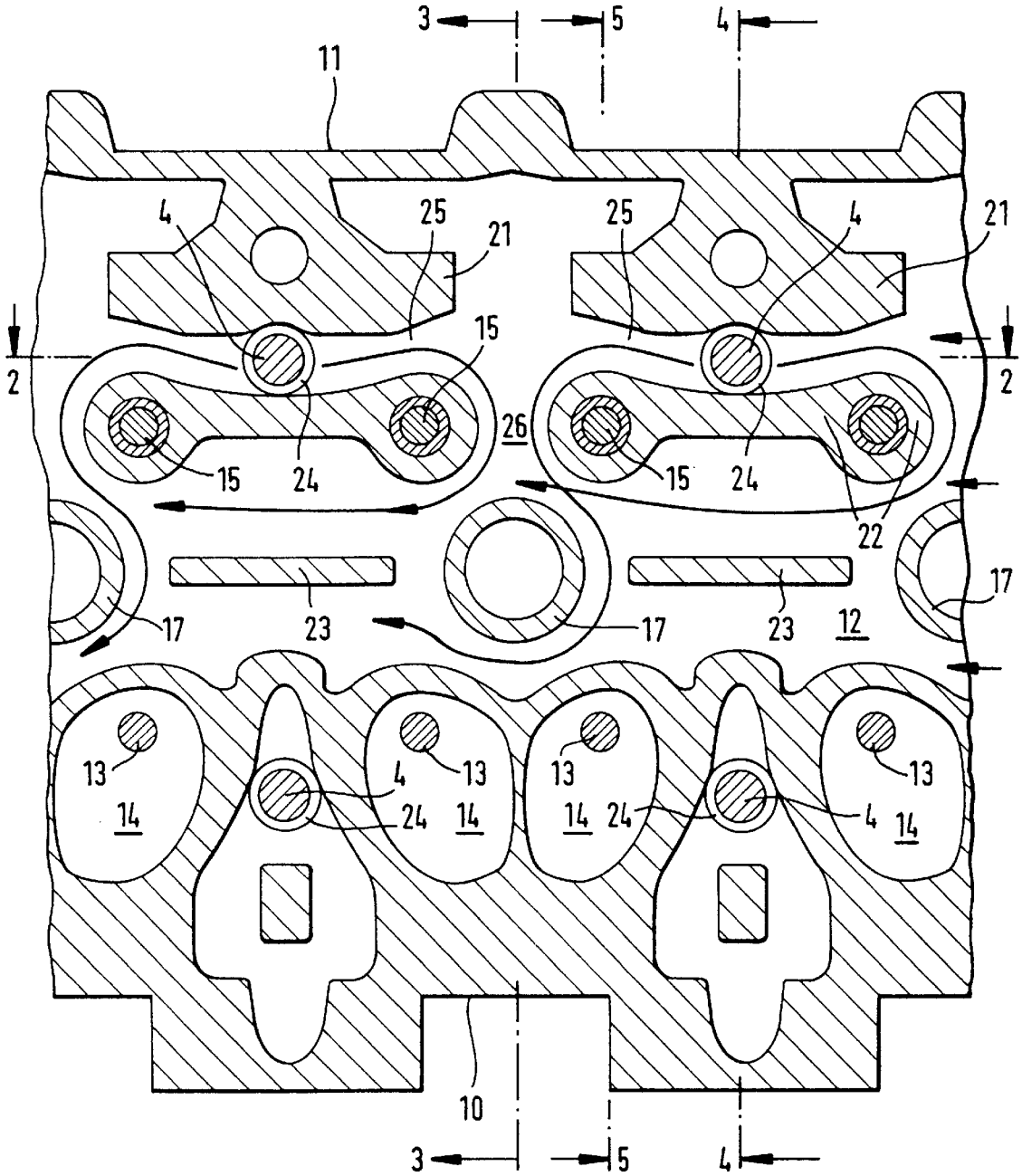
FIG. 6 is a cross-sectional view taken along lines 6—6 of FIG. 1 and FIG. 5.

As shown in FIG. 6, each of the double ribs 21, 22 is arranged between cross-sectional planes extending through the adjacent dome structures 17. Between the adjacent double ribs, there remains a gap 26 via which the longitudinal channel 25 is in communication with the area of the cooling water space 12, which surrounds the dome structure 17. Since the longitudinal ribs 23 end at a distance from the dome structure 17 as shown in FIG. 6, the cooling water flows fully around the dome structure 17 and provides for intense cooling thereof and of the adjacent cylinder head bottom wall which is the combustion chamber top wall (see FIG. 3). Particularly, cooling water is directed from the gap 26 of the longitudinal channel 25 downwardly onto the hot cylinder head bottom wall which results in an intense cooling of the cylinder head bottom wall above a cylinder of the engine.

Figure 3:
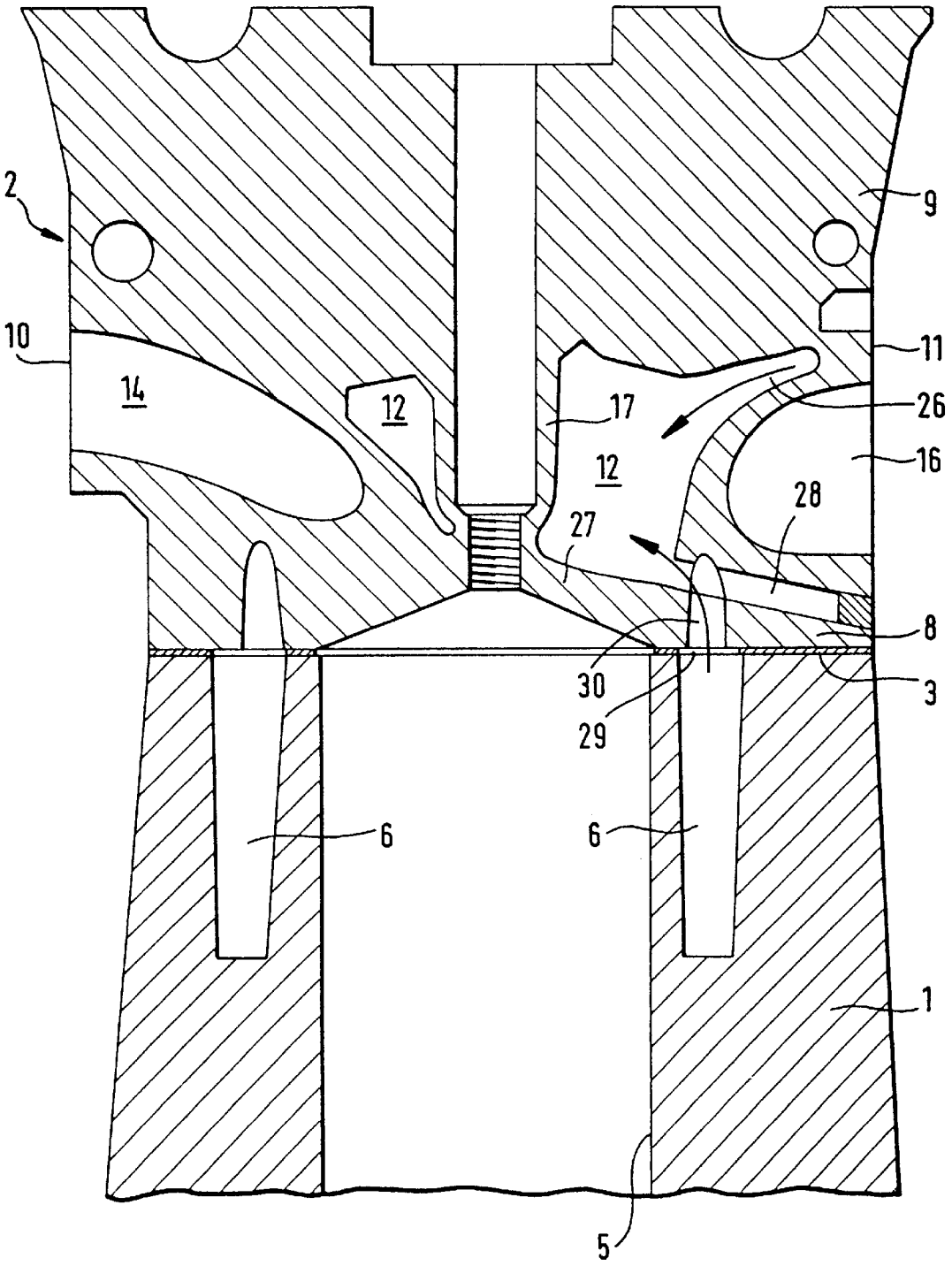
FIG. 3 is a cross-sectional view taken along lines 3—3 of FIG. 1 and FIG. 6.

In order to achieve a good cooling of the web area between adjacent exhaust passages, the web area includes a web cooling bore 28 (FIG. 3). The bore is in communication via the outer oval water space 30, with the cooling water space 6 in the engine block 1 by way of openings 29 in the cylinder head gasket 3 and, with the longitudinal channel 25 by way of the area of the cooling water space 12 around the dome structure 17 and the gap 26. By appropriate dimensioning of the openings 29, the cooling water flow entering through the bores 28 can be controlled. In this way, a very good uniform cooling effect can be achieved for the hot areas of the exhaust side of the cylinder head by a transverse flow from the gap 26 and the bore 28 inspite of the generally longitudinally extending cooling water flow direction.

What is claimed is:

1. A liquid cooled multi-cylinder internal combustion engine comprising an engine block with cylinders and a block cooling water space, a cylinder head mounted on said engine block by cylinder head bolts with a cylinder head gasket disposed between said cylinder head and said engine block, said cylinder head having a cylinder head bottom wall, a cylinder head top wall and outer side walls defining therebetween a cylinder head cooling water space, with intake passages extending from one side wall and exhaust passages extending to the opposite side wall of the cylinder head, a dome structure formed in said cylinder head over each cylinder for receiving a spark plug or a fuel injector, said cylinder head and said gasket having openings providing for communication between said engine block water space and said cylinder head water space and said cylinder head bolts extending through some of said openings in spaced relationship from the opening walls such that cooling water flowing from said engine block water space through said openings to said cylinder head water space flows along said cylinder head bolts thereby maintaining said bolts at cooling water temperature, said cylinder head including in said cylinder head water space longitudinal ribs extending in the longitudinal direction of the cylinder head between said cylinder head bottom and top walls.

2. An internal combustion engine according to claim 1, wherein said cylinder head includes in the area of said exhaust passages longitudinally extending double ribs and forming a space therebetween and, at the exhaust side of said cylinder head, said bolts extend through the space between said double ribs, said double ribs defining, above said exhaust passages, a longitudinal channel which is in communication with the engine block water space by way of the openings in said gasket and said cylinder head bolts extend through said openings into said engine block.

3. An internal combustion engine according to claim 2, wherein said double ribs extend between transverse planes defined by adjacent dome structures, and between adjacent double ribs, there is a gap by way of which the longitudinal channel is in communication with the area of said cylinder head cooling water space surrounding the respective dome structure.

4. An internal combustion engine according to claim 1, wherein each cylinder has two exhaust passages and a web is formed between the two exhaust passages, said web including a transverse bore providing for communication between the engine block cooling water space and the area of the cylinder head cooling water space around said dome structure.

5. An internal combustion engine according to claim 1, wherein longitudinal ribs extending between the cylinder head bottom and top walls are arranged between adjacent dome structures.

6. An internal combustion engine according to claim 5, wherein said longitudinal ribs end at a distance from said dome structures.

* * * * *